US005318115A

United States Patent [19]

Rouse

[11] Patent Number: 5,318,115

[45] Date of Patent: Jun. 7, 1994

[54] CASING CUTTING AND RETRIEVING TOOL

[75] Inventor: Geofrey O. Rouse, Aberdeen, Scotland

[73] Assignee: Weatherford U.S., Inc., Houston, Tex.

[21] Appl. No.: 97,313

[22] Filed: Jul. 23, 1993

Related U.S. Application Data

[63] Continuation of Ser. No. 949,399, Sep. 22, 1992, abandoned.

[30] Foreign Application Priority Data

Sep. 24, 1991 [GB] United Kingdom ..... 9120298

[51] Int. Cl.[5] ..... E21B 31/16

[52] U.S. Cl. ..... 166/55.7; 166/55.8; 166/361

[58] Field of Search ..... 166/55.7, 55.8, 55.6, 166/361, 98, 68.5

[56] References Cited

U.S. PATENT DOCUMENTS

| | | | |
|---|---|---|---|
| 3,489,211 | 1/1970 | Kammerer, Jr. | 166/361 |
| 3,983,936 | 10/1976 | Kennard et al. | 166/55.8 X |
| 4,047,568 | 9/1977 | Anlenbacher | 166/298 |
| 4,191,255 | 3/1980 | Rives | 166/297 |
| 4,550,781 | 11/1985 | Kagler, Jr. | 166/340 |
| 4,703,802 | 11/1987 | Bryan et al. . | |
| 4,969,514 | 11/1990 | Morris et al. | 166/55.7 X |

*Primary Examiner*—Hoang C. Dang
*Attorney, Agent, or Firm*—Guy McChung

[57] ABSTRACT

A casing cutting and retrieving tool is described which includes a grapple device (2) for mechanically gripping casing to be retrieved. A mud motor having upper and lower stators (70, 73) and a rotor is also provided. The upper stator (70) acts as a suspension device for suspending the grapple device (2) from a drill string, and the upper stator (70) is mechanically fast with the grapple device (2). A rotary cutter (76) depends from a drive end (74) of the rotor and is rotatable by the rotor to cut the casing at a location below the grapple device (2).

7 Claims, 4 Drawing Sheets

CASING CUTTING AND RETRIEVING TOOL

This application is a continuation of application Ser. No. 07/949,399, filed Sep. 22, 1992, now abandoned.

This invention relates to an oil well casing cutting and retrieving tool and is particularly applicable to tools used for wellhead abandonment.

BACKGROUND OF THE INVENTION

It is known to cut and retrieve wellheads on abandonment using a single-trip tool which combines a casing cutter and a grapple for engaging the wellhead. An example of such an arrangement is shown in our published International Patent Application No W091/02138. That application, and other prior art, describes an arrangement in which the cutter is driven by rotating the entire string from the surface platform. While this is satisfactory in many cases, problems can arise especially in deep water from poor alignment of the wellhead with the rotary table or from the torsional elasticity of the string.

It is also known to drive the cutter by means of a mud motor, with a view to avoiding the foregoing problems. This has been done, however, using a standard mud motor connected above the wellhead, driving the cutter via a mandrel extending through the grapple. Such an arrangement has a number of disadvantages. The pull which can be exerted through the mud motor is limited typically to about 200,000–250,000 lbs, whereas a significantly higher force is desirable for removing the wellhead after cutting. Also, the swivel connections normally provided above and below the mud motor can be damaged by transverse loads, and such loads are common in wellhead retrieval due to axial misalignment or whipping effects in the string, especially in deep water.

SUMMARY OF THE INVENTION

In accordance with the present invention a casing cutter and retrieving tool comprises grapple means for mechanically gripping the casing to be retrieved, means for suspending the grapple means from a drill string, a mud motor having a stator and a rotor, the stator being mechanically fast with the grapple means, and a rotary cutter depending from a drive end of the rotor and rotatable by the rotor to cut the casing at a location below the grapple means.

Preferably, the mud motor stator is in two parts secured on either side of the grapple means, the upper stator part also acting as said suspending means.

In its preferred form the invention is used for wellhead recovery, and the grapple means is adapted for engagement with a wellhead.

Preferably, the grapple means grips the exterior of the wellhead. Typically, the grapple means grips a shaped profile on the exterior of the wellhead. However, the grapple means could grip the interior of the wellhead or casing, for example by a screw thread engagement.

Preferably also, the grapple means includes an annular seat for engagement with a corresponding upwardly-facing formation of the wellhead.

BRIEF DESCRIPTION OF THE DRAWINGS

An example of a casing cutting and retrieving tool in accordance with the invention will now be described with reference to the accompanying drawings, in which.

DESCRIPTION OF PREFERRED EMBODIMENTS

Figure 1:
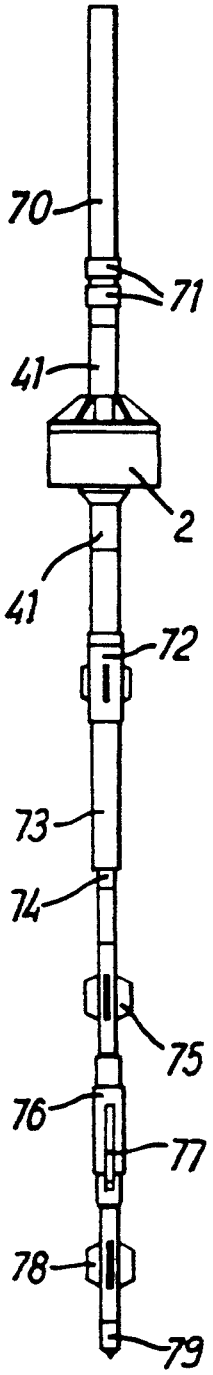
FIG. 1 shows a casing cutting and retrieving tool in an engaged and non-cutting position.

FIG. 1 shows a casing cutting and retrieving tool for connection to the end of a drill string (not shown). The tool comprises an upper mud motor stator 70 having clamps 71 mounted thereon. The upper stator 70 is connected to a central shaft 41 of a wellhead removal tool 2. The lower section of the central shaft 41 is connected to a stabiliser 72 which has its other end connected to a lower mud motor stator 73.

Figure 6:
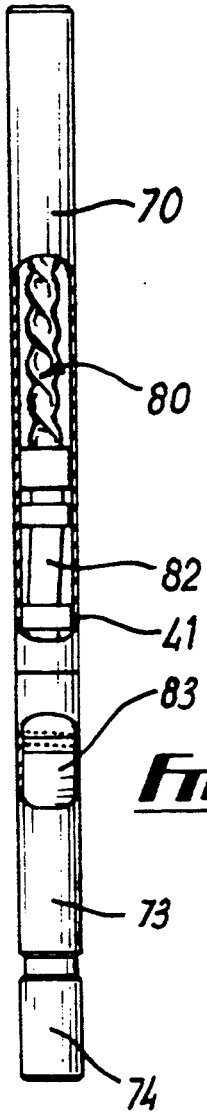
FIG. 6 shows a cut away view of a mud motor for use in the apparatus shown in FIGS. 1 to 3.
Figure 7:
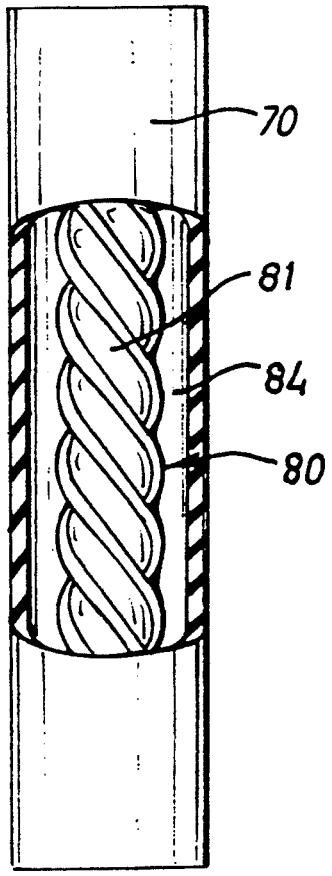
FIG. 7 shows a cut away view of a power section of the mud motor shown in FIG. 6 in detail: and, FIG. 8 is a cross-sectional view through the power section shown in FIG. 7.
Figure 8:
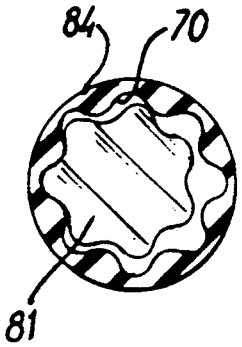

Mounted within the stator 70 is a rotor 80. FIG. 6 shows the mud motor section of the casing cutting and retrieving tool in detail with cut away views showing internal components of the mud motor. Located in the upper stator 70 is the power section 80 which comprises a multi-lobe rotor 81 mounted within an elastomeric lining 84 of the upper stator 70 (see also FIGS. 7 and 8). The elastomeric lining 84 is bonded inside the upper stator 70. The number of lobes on the elastrometic lining 84 is eight and the rotor 81 has seven corresponding lobes. This permits rotation of the rotor 81 within the lining 84. The flow of liquid through the upper stator 70 creates hydraulic pressure that causes the rotor 80 to precess as well as rotate within the stator 70.

Coupled to the end of the rotor 80 is a transmission assembly 82 which is located within the central shaft 41. The transmission assembly transmits the rotational speed and torque produced by the power section to an output shaft 83. The output shaft is a rigidly constructed hollow steel component supported within the lower stator 73 by radial and thrust bearings. A drive end 74 is coupled directly onto the output shaft 83.

Coupled to the drive end 74 is a stabiliser 75 and the lower end of the stabiliser is coupled to a casing cutter 76 which includes four cutting blades 77 positioned at right angles to each other around the circumference of the casing cutter 76. In FIG. 1, the cutting blades 77 are in the retracted position in which they lie flush with the housing of the casing cutter 76. Below the casing cutter 76 is another stabiliser 78 which has a bull sub 79 connected to its lower end.

Figure 2:
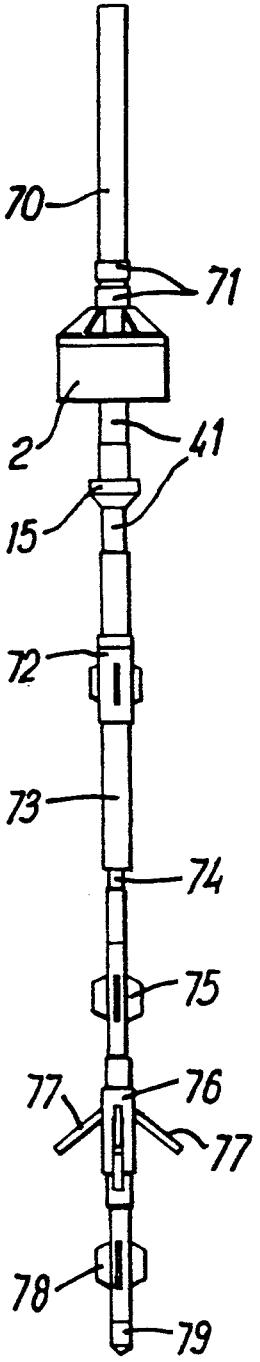
FIG. 2 shows the casing cutting and retrieving tool, of FIG. 1 in a cutting position.

FIG. 2 shows the casing cutting and retrieving tool in a second cutting position in which the central shaft 41 is moved downwards relative to the wellhead cutting and retrieving tool 2 until the safety clamps 71 abut against the upper end of the housing 7 of the wellhead retrieving tool 2. In this position a liquid is pumped through the upper drill string into the upper stator 70 to drive the rotor within the stator 70. The flow of liquid acting downwards against the helical shaped shaft of the rotor causes the rotor to rotate within the upper stator 70 which in turn causes rotation of the concentric shaft of the rotor which extends from the helically shaped portion of the rotor to the drive end 74, and hence rotation of the casing cutter 76. The cutting blades 77 are moved to the cutting position, shown in FIG. 2, by means of the liquid flow within the cutting retrieving tool. Typically, the liquid used to drive the rotor of the mud motor and to extend the cutting blades 77 of the casing cutter 76, is water and where the cutting and retrieval tool is used offshore then the liquid is preferably seawater. However, other liquids such as drilling mud could be used.

Figure 4:
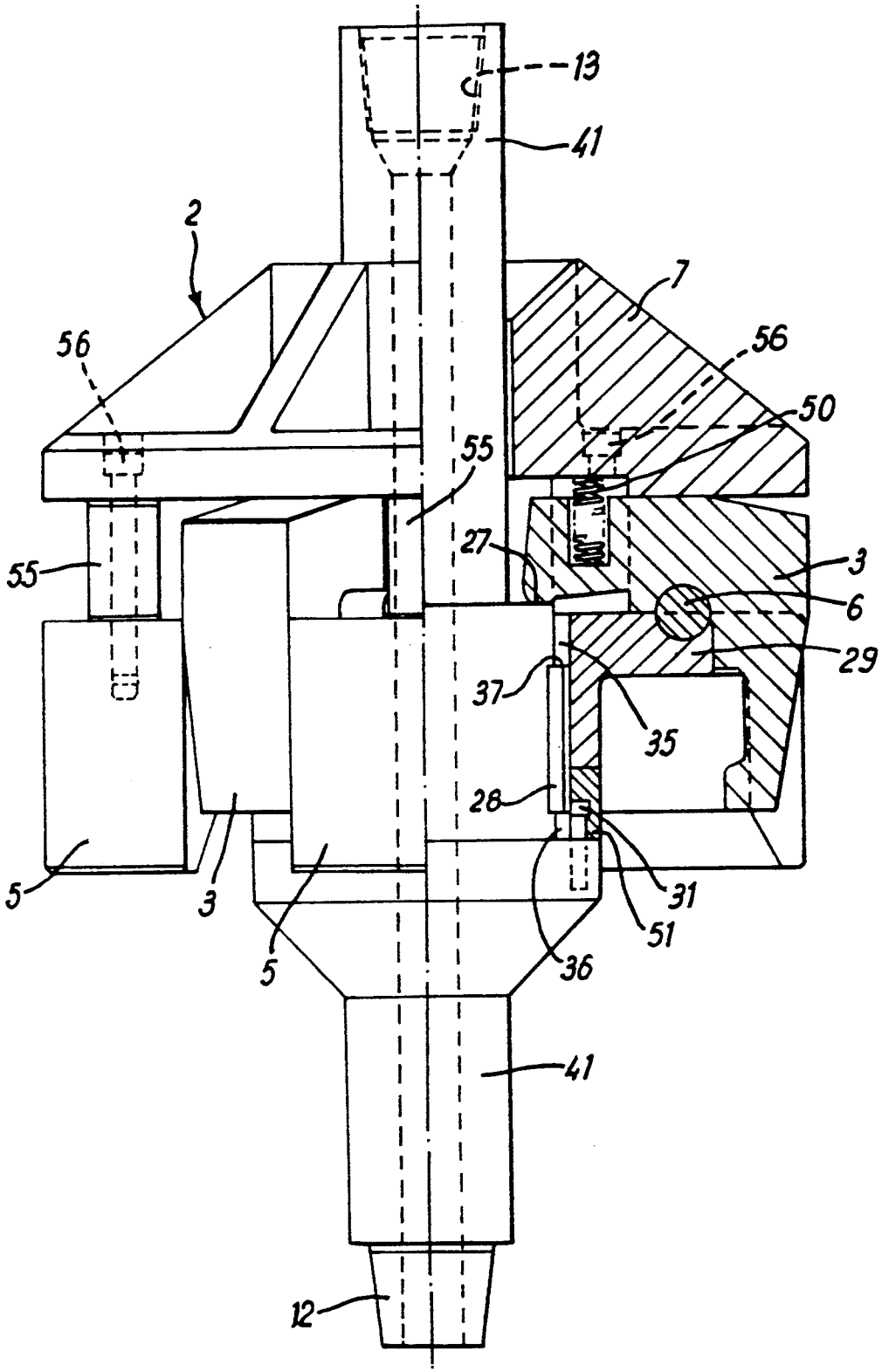
FIG. 4 is a partial cross-sectional view through a wellhead removal tool for use in the apparatus shown, in FIGS. 1 to 3.

FIG. 4 shows the wellhead removal tool 2 in more detail. The tool 2 has three engagement arms 3 (only two shown). The engagement arms 3 attach on to an external profile 4 of the wellhead 1.

The engagement arms 3 are mounted in a protective skirt 5 by means of a pivot 6. The pivot 6 enables the engagement arms 3 to pivot from an engaged position, where they engage the wellhead 1, to a disengaged position. The engagement arms 3 are biased towards the disengaged position by means of helical springs 50 (only one shown).

Mounted on top of the protective skirt 5 and above the engagement arms 3 there is an upper housing 7. The skirt 5 is bolted to the upper housing 7 by bolts 56 and separated from the upper housing by three spacers 55 located circumferentially around the tool 2 between adjacent arms 3.

A central shaft 41 extends through the centre of the tool 2 and a square shoulder 15 is formed on the shaft 41. The shaft 41 is provided with a threaded box connector 13 at its upper end and a threaded pin connector 12 at its lower end.

Figure 5A:
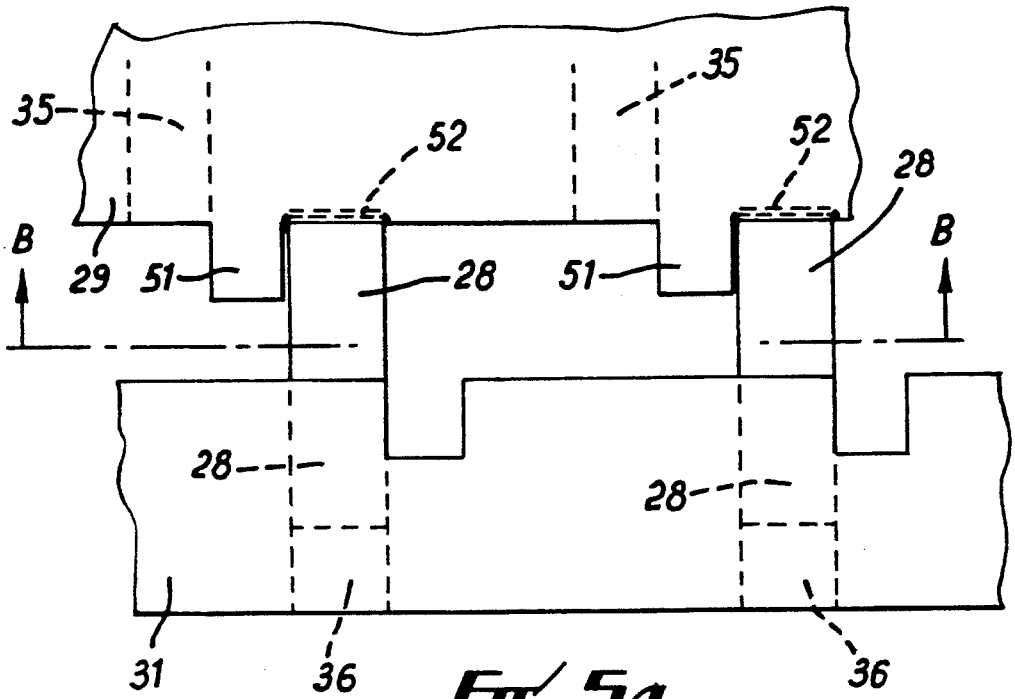
FIG. 5*a* is a detailed schematic view of an engagement and disengagement mechanism for use in the tool shown in FIG. 4.
Figure 5B:
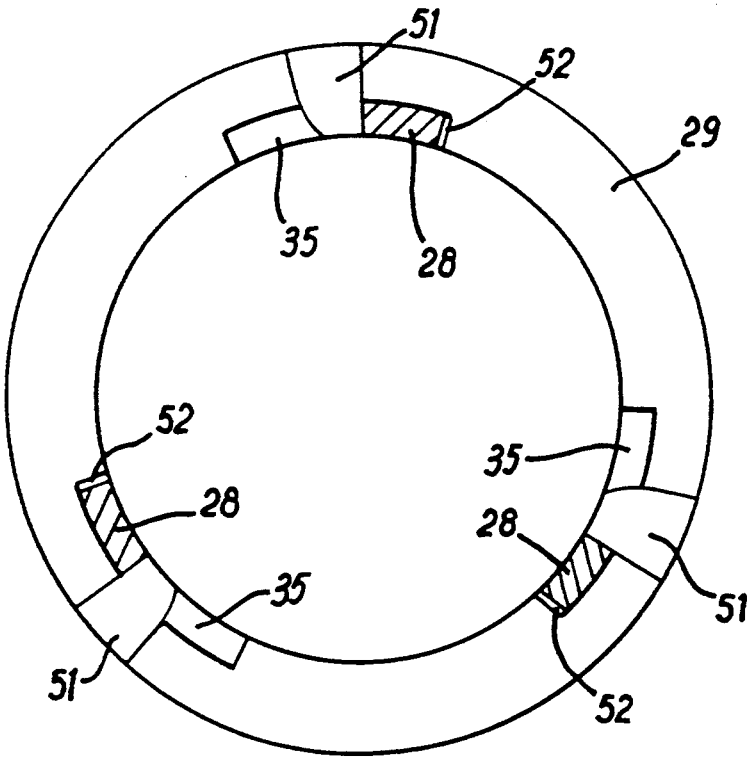
FIG. 5*b* is a view along the line B-B in FIG. 5*a;*

In order to facilitate engagement and disengagement of the square shoulder 15, three keys 28 are provided on the outside surface of the square shoulder 15 and cooperating slots 35, 36 are provided in a main body housing 29 and a thrust adapter 31 respectively of the tool 2 and this is shown in more detail in FIGS. 5*a* and 5*b*. The thrust adapter 31 is fixed to the shaft 41 and so the slots 36 in the thrust adapter 31 are always engaged with the respective keys 28. Rotation of the shaft 41 in an anticlockwise direction causes the square shoulder 15 and hence the keys 28 to rotate so that they may be aligned with the respective slots 35 in the main body housing 29. When the keys 28 are aligned with the slots 35, the shaft 41 and the square shoulder 15 may be moved upwards to the position shown in FIG. 4, where the square shoulder 15 has pivoted the arms 3 to the engaged position against the biassing action of the spring 50.

If the shaft 41 is then pushed downwards so that the top edge 37 of the keys 28 are below the lower edge of the main body housing 29, the shaft 41 and the square shoulder 15 can be rotated relative to the main body housing 29 to misalign the keys 28 with the slots 35 to prevent the square shoulder 15 moving up to activate the engagement arms 3. This enables removal of the tool from the wellhead. The main body housing 29 also has a lug 51 on its lower edge adjacent each slot 35. The lugs 51 provide a positive stop for alignment and misalignment of the keys 28 with the slots 35. In addition, there is also a recess 52 adjacent each lug 1 which cooperates with the top edge of each key 28 to help prevent the keys 28 being jarred into alignment with the slots 35 during lowering of the tool on to the wellhead 1. This would cause the square shoulder 15 to move up and pivot the arms to the engaged position prematurely. If this happened, the tool 2 would not engage the wellhead 1 properly.

Figure 3:
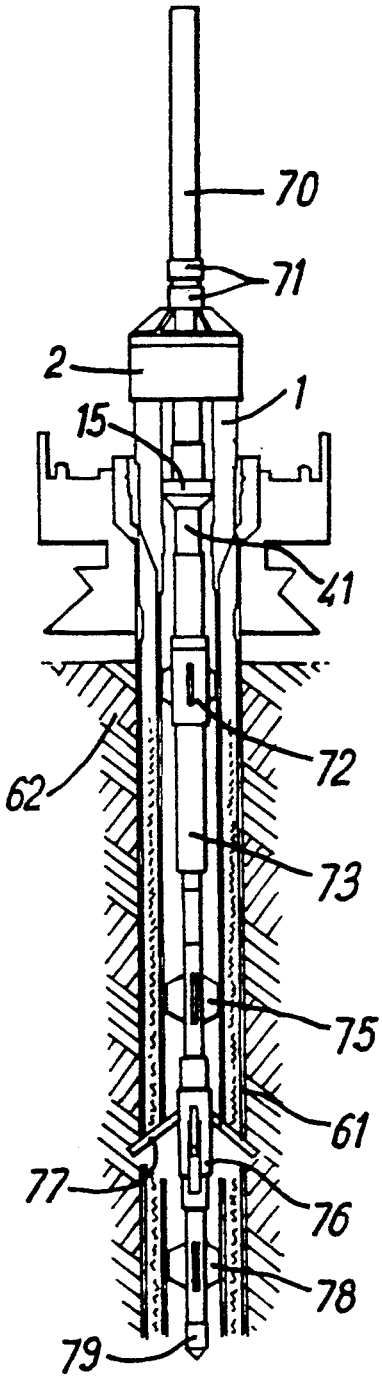
FIG. 3 shows the casing cutting and retrieving tool shown in FIGS. 1 and 2, in the cutting position and in use.

In use, as shown in FIG. 3, the casing cutting and retrieving tool is lowered until the tool 2 rests on a wellhead 1. The shaft 41 is then forced downwards to the position shown in FIG. 3. A drive fluid, such as sea water is then pumped down the drill string to drive the rotor in the mud motor and the cutting blades 77 of the casing cutter 76 are activated to move to the cutting position shown in FIG. 3. The blades 77 are rotated by the rotating rotor of the mud motor to cut the casing 61. After the casing has been cut by the casing cutter 76, rotation of the drive end 74 is stopped by stopping pumping of sea water through the apparatus. The shaft 41 is then rotated in order to align the keys 28 with the slots 35, so that the square shoulder 15 may move upwards to pivot the engagement arms 3 to the engaged position. When this position has been achieved the upward tension on the shaft 41 can be increased as desired in order to pull the wellhead 1 away from the sea-bed 62. The upward tension is transmitted through the upper stator 70, shaft 41 and shoulder 15, and not on the rotor in the stator 70.

If for some reason the wellhead 1 does not become disengaged then the shaft 41 is pushed downwards in order to disengage the square shoulder 15 from the engagement arms 3 and allow the spring 50 to pivot the engagement arms 3 to the disengaged position. The shaft 41 is rotated to misalign the keys 28 with the slots 35. The top edge 37 of the key 28 is then prevented from moving up by the lower edge of the main body housing 29 and hence the square shoulder 15 is prevented from moving up and pivoting the engagement arms 3 to the engaged position when the shaft 11 is pulled upwards. This enables the shaft 41 to be pulled upwards without the engagement arms 3 engaging the external profile 4 of the wellhead 1 so that the casing cutting and retrieving tool may be recovered from the wellhead when it is not possible to remove the wellhead after the casing has been cut.

Generally, the three engagement arms 3 are situated at 120 degree intervals around the circumference of the tool 2 and this gives optimum distribution of pulling forces between the wellhead 1 and each engagement arm 3.

Since the pull required for removal is transmitted from the tool to the wellhead without passing through the rotor, very high tensions of up to 600,000 lbs may be applied.

The manner of mounting the mud motor within, rather than above, the wellhead retrieval tool 2 or grapple assembly ensures that the effect of any transverse forces in the drill string on the motor and the cutter is minimised.

The tool may utilise readily available mud motors. A typical example is a Drillex Systems D950 motor which gives a torque of 7,000 ft lb at 160–180 RPM with a sea water supply of 800 gal/min at 1,000 PSI with an A-1 Homco model 24 four bladed cutter for cutting 20" and 30" casing.

The mud motor could alternatively be disposed entirely under the grapple assembly. The split arrangement described is, however, preferred since this gives a smaller depth of cut beneath the wellhead.

The invention may equally be used in tools which grip the wellhead internally rather than externally, and may be used in tools for cutting in both tension and compression. It may also be used in tools for cutting and removing casing other than wellheads.

Modifications and improvements may be incorporated without departing from the scope of the invention.

I claim:

1. A casing cutting and retrieving tool comprising grapple means for mechanically gripping the casing to be retrieved, means for suspending the grapple means from a drill string, a mud motor having a stator and a rotor, the stator being mechanically fast with the grapple means, and a rotary cutter depending from a drive end of the rotor and rotatable by the rotor to cut the casing at a location below the grapple means.

2. A tool according to claim 1, wherein the stator acts as the suspending means.

3. A tool according to claim 1, wherein the stator comprises an upper stator portion and a lower stator portion, the grapple means being located between the stator portions.

4. A tool according to claim 3, wherein the upper stator portion acts as the suspending means.

5. A tool according to claim 1, wherein the drive end of the rotor is located on the opposite side of the grapple means from the suspension means.

6. A tool according to claim 1, wherein the grapple means mechanically grips a wellhead.

7. A tool according to claim 6, wherein the grapple means mechanically grips the exterior of the wellhead.

* * * * *